US007304457B1

(12) United States Patent
Huang

(10) Patent No.: US 7,304,457 B1
(45) Date of Patent: Dec. 4, 2007

(54) BRIDGELESS POWER FACTOR CORRECTOR CIRCUIT AND CONTROL METHOD THEREOF

(76) Inventor: Ming-Ho Huang, No. 25, Wu-Gong 6TH Rd., Wu-Ku Industrial Park, Taipei Hsien (TW)

( * ) Notice: Subject to any disclaimer, the term of this patent is extended or adjusted under 35 U.S.C. 154(b) by 0 days.

(21) Appl. No.: 11/493,782

(22) Filed: Jul. 26, 2006

(30) Foreign Application Priority Data

Apr. 25, 2006 (TW) ..... 95114697 A

(51) Int. Cl.
*G05F 1/10* (2006.01)
*G05F 1/652* (2006.01)
*G05F 1/613* (2006.01)

(52) U.S. Cl. ..... 323/222; 323/282; 323/284

(58) Field of Classification Search ..... 323/222, 323/282, 284
See application file for complete search history.

(56) References Cited

U.S. PATENT DOCUMENTS 4,384,321 A * 5/1983 Rippel ..... 363/124
5,519,306 A * 5/1996 Itoh et al. ..... 323/222
5,550,458 A * 8/1996 Farrington et al. ..... 323/222
5,856,919 A * 1/1999 Moriarty, Jr. ..... 363/101
5,894,214 A * 4/1999 Jiang ..... 323/222
6,028,418 A * 2/2000 Jovanovic et al. ..... 323/222
6,525,513 B1 * 2/2003 Zhao ..... 323/222
7,116,087 B2 * 10/2006 Zhang et al. ..... 323/272

* cited by examiner

*Primary Examiner*—Bao Q. Vu
(74) *Attorney, Agent, or Firm*—Law Offices of John Chupa & and Associates, P C

(57) ABSTRACT

The present invention discloses a bridgeless rectified power factor corrector circuit and control method thereof. The bridgeless rectified power factor corrector circuit includes a power factor corrector inductor, two diode rectifiers, a control unit, two power MOS switches and an energy-storage capacitor to define a complete booster circuit. Unlike the traditional control method of a bridgeless rectified power factor corrector circuit, the control method of the invention has lower conduction loss and higher conversion efficiency.

7 Claims, 2 Drawing Sheets

BRIDGELESS POWER FACTOR CORRECTOR CIRCUIT AND CONTROL METHOD THEREOF

BACKGROUND OF THE INVENTION

1. Field of the Invention

The present invention relates to a bridgeless power factor corrector circuit, more particularly to a bridgeless power factor corrector circuit having a first switch and a second switch for facilitating a positive half cycle and a negative half cycle to provide a separate electrically conducting path to reduce conduction loss.

2. Description of the Related Art

A bridgeless rectified power factor corrector circuit is generally used in a high-efficiency power supply for improving power factor. In traditional methods, two metal oxide semiconductor field effect transistors (MOSFET) M1, M2 are turned electrically ON or OFF at the same time.

The shortcoming of the foregoing control method resides on that if the MOSFET M1 and the MOSFET M2 are turned OFF at the same time, a current will pass through a diode (positive half cycle) of the MOSFET M2 and a diode (negative half cycle) of the MOSFET M1 separately and thus causing a large conduction loss.

In view of the aforementioned shortcoming, the present invention provides a control method for a bridgeless rectified power factor corrector circuit to overcome the foregoing shortcoming.

SUMMARY OF THE INVENTION

Therefore, it is a primary objective of the present invention to provide a bridgeless power factor corrector circuit having a first switch and a second switch for facilitating a positive half cycle and a negative half cycle to provide a separate electrically conducting path to reduce conduction loss and improve conversion efficiency.

Another objective of the present invention is to provide a control method for a bridgeless power factor corrector circuit, and the method provides a first switch, a second switch and a control unit for facilitating a positive half cycle and a negative half cycle to provide separate electrically conducting paths, so as to reduce conduction loss and improve conversion efficiency.

To achieve the foregoing objectives of the present invention, a bridgeless power factor corrector circuit comprises an inductor with an end coupled to a line input terminal; a first diode with an end coupled to another end of the inductor; a second diode with an end coupled to a neutral input terminal; a control unit having an input terminal coupled separately to the line input terminal and the neutral input terminal; a first switch being a three-terminal component with a first terminal coupled to the control unit, a second terminal coupled separately to the first diode and the inductor for receiving a control of the control unit to be turned on or off; a second switch being a three-terminal component with a first terminal coupled to the control unit, a second terminal coupled separately to the second diode and the neutral input terminal for receiving a control of the control unit to be turned on or off; and a capacitor with an end coupled to the first diode and another end of the second diode, and another end of the capacitor is coupled to the first switch and a third terminal of the second switch. With the control of the control unit at a positive half cycle, a current passes through the line input terminal, inductor, first diode, inductor and second switch to the neutral input terminal to form a circuit; with the control of the control unit at a negative half cycle, a current passes through the neutral input terminal, second diode, capacitor, first switch and inductor to the line input terminal to form a circuit, so as to reduce the conduction loss of the power factor corrector circuit.

To achieve the foregoing objectives, a control method for a bridgeless rectified power factor corrector circuit in accordance with the present invention is used for controlling a conduction efficiency of a power factor corrector circuit, wherein the power factor corrector circuit comprises an inductor, a first diode, a second diode, a control unit and a capacitor, and the method comprises the steps of: providing a first switch coupled separately to the control unit, the first diode and the inductor; providing a second switch coupled separately to the control unit, the second diode and the neutral input terminal; and the control unit at a positive half cycle drives the second switch to continue an electric connection, and the first switch is electrically connected first and then disconnected; and the control unit at a negative half cycle drives the first switch to continue an electric connection, and the second switch is electrically connected first and then disconnected, so as to reduce the conduction loss of the power factor corrector circuit.

The characteristics and objectives of the "circuit" of the present invention will be described together with related drawings in detail as follows.

DETAILED DESCRIPTION OF THE PREFERRED EMBODIMENTS

The structure, technical measures and effects of the present invention will now be described in more detail hereinafter with reference to the accompanying drawings that show various embodiments of the invention.

Figure 1:
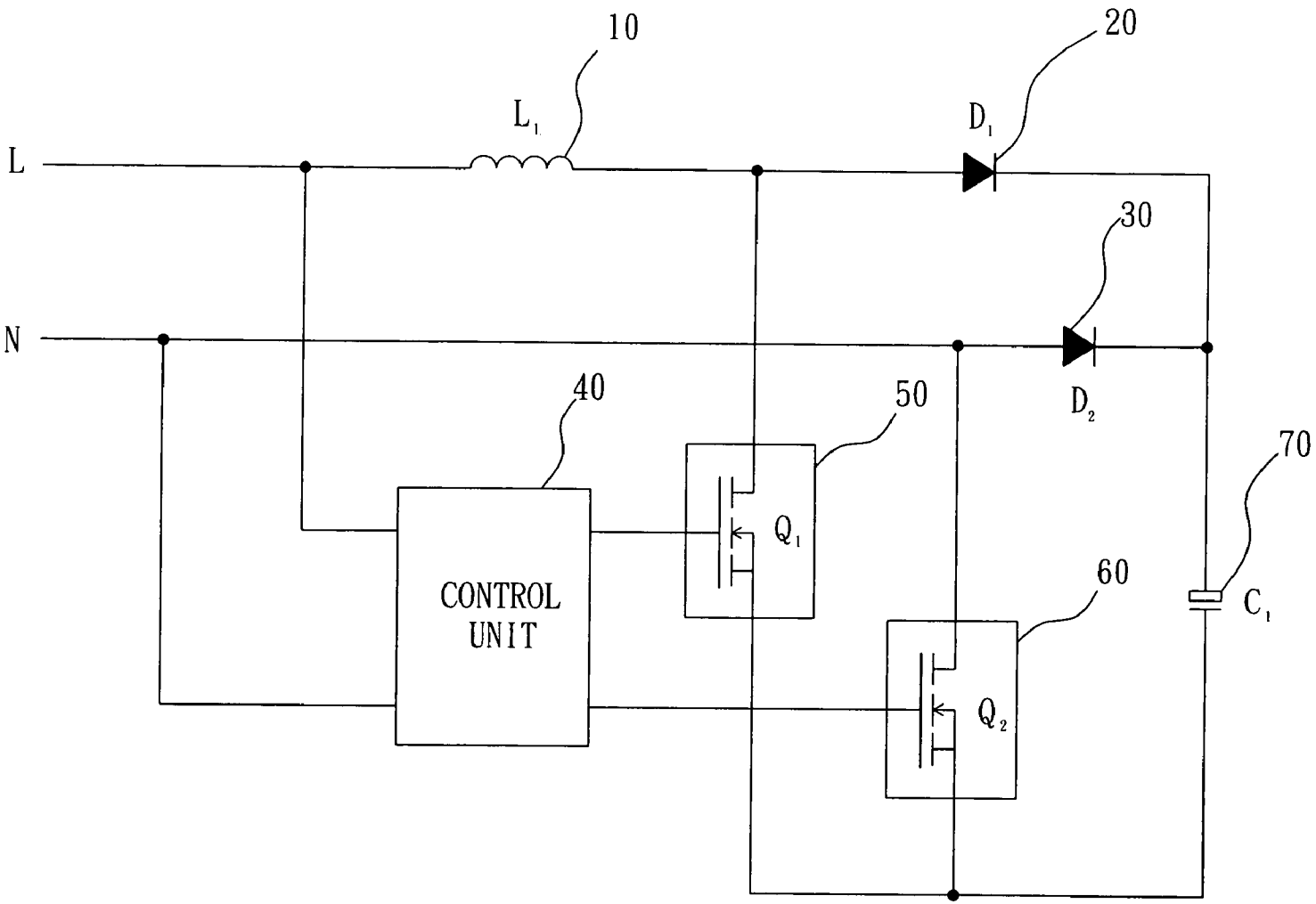
FIG. 1 is a schematic block diagram of a bridgeless power factor corrector circuit according to a preferred embodiment of the present invention.

Referring to FIG. 1 for the schematic block diagram of a bridgeless power factor corrector circuit according to a preferred embodiment of the invention, the bridgeless power factor corrector circuit comprises an inductor 10; a first diode 20; a second diode 30; a control unit 40; a first switch 50; a second switch 60; and a capacitor 70.

An end of the inductor 10 is coupled to a line input terminal (Line, L) for storing energy, but a general power supply is a prior art and will not be described here.

The first diode 20 including but not limited to a rectifier diode (hereinafter referred to as a first rectifier diode 20) with an end coupled to another end of the inductor 10 for providing a half-wave rectification function, but it is a prior art power supply, and thus will not be described here.

The second diode 30 including but not limited to a rectifier diode (hereinafter referred to as a second rectifier diode 30) with an end coupled to a neutral input terminal (Neutral, N) for providing a half-wave rectification function, but it is a prior art power supply, and thus will not be described here.

An input terminal of the control unit 40 is coupled separately to the line input terminal and the neutral input terminal, and the outputs separately control the electric connection and disconnection of the first switch 50 and the second switch 60, wherein the control unit 40 is a controller including but not limited to a power factor corrector.

The first switch 50 is a three-terminal component, which could be any power switch including but not limited to a N-channel MOSFET, a N-channel JFET, a P-channel MOSFET or a P-channel JFET (hereinafter referred to as a first MOS switch 50) with a first terminal coupled to the control unit 40, a second terminal coupled separately to the first diode 20 and the inductor 10 for receiving a control of the control unit 40 to be turned on or off, wherein the first terminal is a gate of the MOSFET 50, and the second terminal is a source of the MOSFET 50, and the third terminal is a drain of the MOSFET 50.

The second switch 60 is a three-terminal component, which could be any power switch including but not limited to a N-channel MOSFET, a N-channel JFET, a P-channel MOSFET or a P-channel JFET (hereinafter referred to as a second MOS switch 60) with a first terminal coupled to the control unit 40, a second terminal coupled separately coupled to the second rectifier diode 30 and the neutral input terminal for receiving a control of the control unit 40 to be turned on or off, wherein the first terminal is a gate of the MOSFET, and the second terminal is a source of the MOSFET, and the third terminal is a drain of the MOSFET.

An end of the capacitor 70 is coupled separately to the first rectifier diode 20 and another end of the second rectifier diode 30, and another end of the capacitor 70 is coupled to the sources of the first MOS switch 50 and the second MOS switch 60, but it is a prior art power supply and thus will not be described here.

At a positive half cycle, the control unit 40 drives the second MOS switch 60 to maintain an electric connection, and the first MOS switch 50 is electrically connected first and then disconnected. If the second MOS switch 60 and the first MOS switch 50 are electrically connected at the same time, a current passes through the line input terminal, inductor 10, first MOS switch 50, second MOS switch 60 and neutral input terminal to store energy to the inductor 10.

If the second MOS switch 60 is electrically connected and the first MOS switch 50 is disconnected, a current passes through the line input terminal, inductor 10, first rectifier diode 20, capacitor 70, second MOS switch 60 and neutral input terminal to discharge energy from the inductor 70.

At a negative half cycle, the control unit 40 drives the first MOS switch 50 to maintain an electric connection and the second MOS switch 60 is electrically connected first and then disconnected. If the first MOS switch 50 and the second MOS switch 60 are electrically connected at the same time, a current passes through the neutral input terminal, second MOS switch 60, first MOS switch 50, inductor 10 and line input terminal to store energy to the inductor 10.

If the first MOS switch 50 is electrically connected and the second MOS switch 60 is electrically disconnected, a current passes through the neutral input terminal, second rectifier diode 30, capacitor 70, first MOS switch 50, inductor 10 and line input terminal to discharge energy from the inductor 70.

In other words, the control unit 40 drives the first MOS switch 50 and the second MOS switch 60 to be electrically connected or disconnected. At a positive half cycle or a negative half cycle, a separate electrically conducting path is provided for reducing conduction loss and improving conversion efficiency. Therefore, the present invention definitely can overcome the shortcomings of the traditional control method for a bridgeless rectified power factor corrector circuit.

Figure 2:
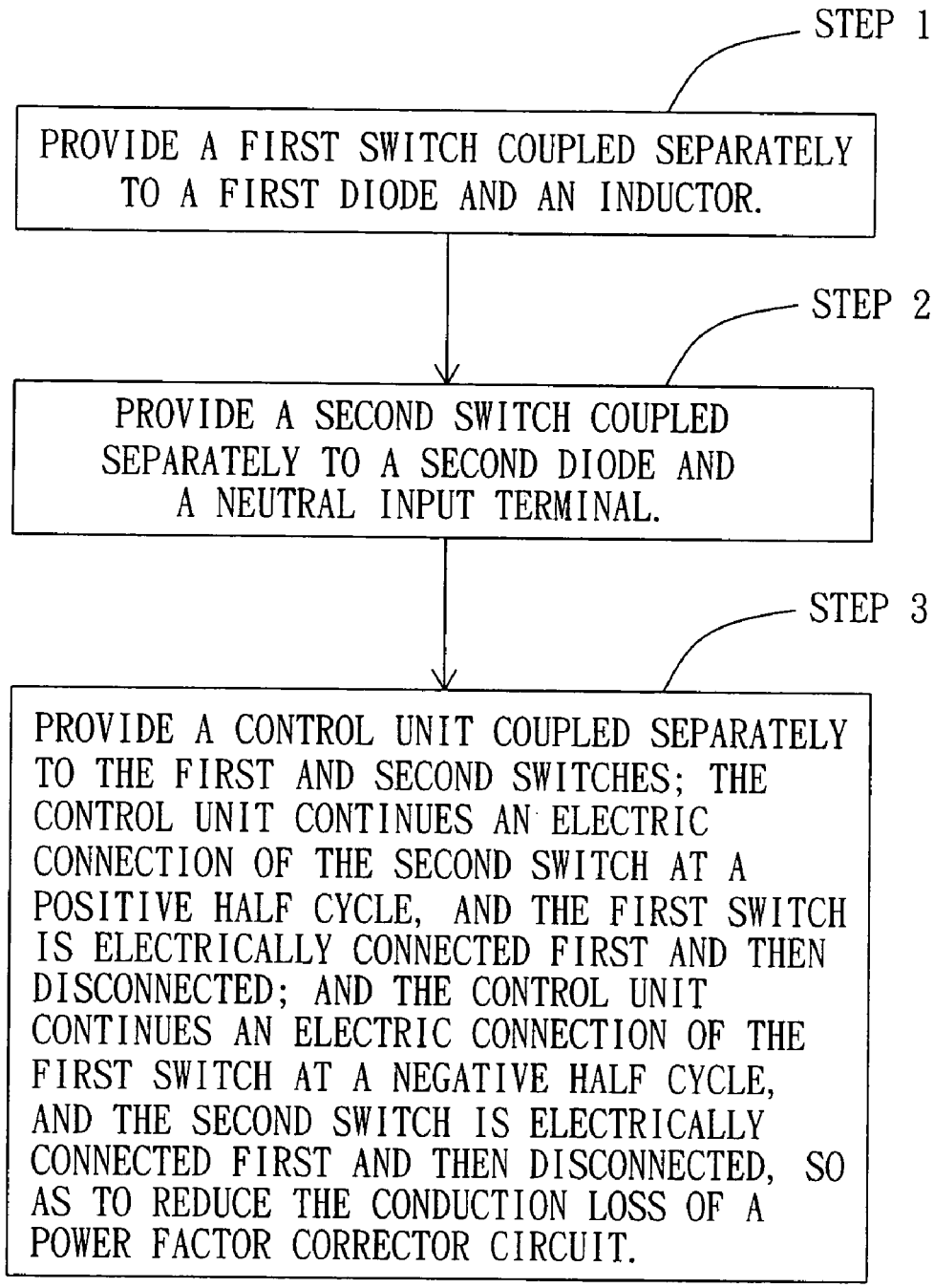
FIG. 2 is a flow chart of a control method for a bridgeless power factor corrector circuit according to another preferred embodiment of the present invention.

Further, the present invention also provides a control method for a bridgeless rectified power factor corrector circuit. Referring to FIG. 2 for a flow chart of the control method for a bridgeless power factor corrector circuit according to a preferred embodiment of the present invention, the control method is provided for controlling the conduction efficiency of a power factor corrector circuit, wherein the power factor corrector circuit comprises an inductor 10, a first diode 20, a second diode 30 and a capacitor 70, and the method comprises the steps of: providing a first switch 50 coupled separately to the first diode 20 and the inductor 70 (Step 1); providing a second switch 60 coupled separately to the second diode 30 and the neutral input terminal (Step 2); and providing a control unit 40 coupled separately to the first switch 50 and the second switch 60, and the control unit 40 at a positive half cycle drives the second switch to maintain an electric connection and the first switch is electrically connected first and then disconnected; and the control unit 40 at a negative half cycle drives the first switch to maintain an electric connection and the second switch is electrically connected and then disconnected, so as to reduce the conduction loss of the power factor corrector circuit (Step 3).

In Steps 1 and 2, a first switch 50 separately coupled to the first diode 20 and the inductor 70 as well as a second switch coupled separately to the control unit, the second diode and the neutral input terminal are provided; wherein the first diode 20, second diode 23, first switch 50 and second switch 60 are described in previous sections, and thus will not be described here again.

In Step 3, the control unit 40 at a positive half cycle drives the second MOS switch 60 to maintain an electric connection, and the first MOS switch 50 is electrically connected first and then disconnected. The control unit 40 at a negative half cycle drives the first MOS switch 50 to maintain an electric connection and the second MOS switch 60 is electrically connected first and then disconnected, so as to reduce the conduction loss of the power factor corrector circuit.

The present invention provides a feasible solution and improves over the prior art, and an application of this invention is duly filed accordingly. However, it is to be noted that the preferred embodiments disclosed in the specification and the accompanying drawings are not intended to limit the invention. To the contrary, it is intended to cover various modifications and similar arrangements and procedures, and thus the scope of the appended claims should be accorded the broadest interpretation so as to encompass all such modifications and similar arrangements and procedures.

What is claimed is:

1. A bridgeless rectified power factor corrector circuit, comprising:

an inductor, having an end coupled to a line input terminal;

a first diode, having an end coupled to another end of said inductor;

a second diode, having an end coupled to a neutral input terminal;

a control unit, having an input terminal coupled separately to said line input terminal and said neutral input terminal;

a first switch, being a three-terminal component with a first terminal coupled to said control unit, a second terminal coupled separately to said first diode and said inductor for receiving a control of said control unit to be turned on or off;

a second switch, being a three-terminal component with a first terminal coupled to said control unit and a second terminal coupled separately to said second diode and said neutral input terminal for receiving a control of said control unit to be turned on or off; and a capacitor, having an end coupled separately to said first diode and another end of said second diode, and another end of said capacitor coupled to said first switch and a third terminal of said second switch;

where, when a first signal is transmitted to said control unit during a positive half cycle, said control unit causes said first terminal of said first switch to be electrically connected coupled to said control unit and said first terminal of said second switch to be electrically connected to said control unit, said second terminal of said first switch to be electrically connected to said inductor and said first diode, and said second terminal of said second switch to be electrically connected to said neutral input terminal, and said third terminal of said first switch to be electrically connected to said third terminal of said second switch, thereby allowing a positive current to only flow through said line input terminal, said inductor, said second terminal of said first switch, said third terminal of said second switch, and said neutral input terminal, thereby truly and completely isolating said positive current from said first diode and said second diode, and allowing said positive current to effectively charge said inductor, and when a second signal is transmitted to said control unit during a positive half cycle, said control unit causes said second terminal of said first switch to be electrically disconnected from said inductor, thereby causing said positive current to pass through said line input terminal, said inductor, said first diode, said capacitor and said second switch to said neutral input terminal to form a circuit thereby discharging said inductor; and where a first signal is transmitted to said control unit during a negative half cycle, said control unit causes said first terminal of said second switch to be electrically connected to said control unit and said first terminal of said first switch to be electrically connected to said control unit, said second terminal of said second switch to be electrically connected to said neutral input terminal and said second terminal of said first switch to be electrically connected to said inductor and said diode and said third terminal of said second switch to be electrically connected to said third terminal of said first switch, thereby allowing a negative current to only flow through said neutral input terminal, said second terminal of said second switch, said third terminal of said first switch, inductor, and said line input terminal, thereby truly and completely isolating said negative current from said second diode and said first diode, and allowing said negative current to effectively charge said inductor, and when a second signal is transmitted to said control unit during a negative half cycle, said control unit causes said second terminal of said second switch to be electrically disconnected from said neutral input terminal, thereby causing said negative current to pass through said neutral input terminal, said second diode, said capacitor, said first switch and said inductor to said line input terminal to form a circuit, thereby discharging said inductor.

2. The bridgeless power factor corrector circuit of claim 1, wherein said first switch and said second switch are power switches.

3. The bridgeless power factor corrector circuit of claim 2, wherein said power switch is a N-channel MOSFET, a N-channel JFET, a P-channel MOSFET or a P-channel JFET.

4. The bridgeless power factor corrector circuit of claim 3, wherein said first terminal is a gate of a MOSFET, and said second terminal is a source of said MOSFET, and said third terminal is a drain of said MOSFET.

5. The bridgeless power factor corrector circuit of claim 1, wherein said first diode and said second diode are rectifier diodes.

6. The bridgeless power factor corrector circuit of claim 1, wherein said control unit is a power factor corrector controller, and said control unit at a positive half cycle drives said second switch to maintain an electric connection, and said first switch is electrically connected first and then disconnected; and said first switch stores energy to said inductor when said first switch is electrically connected, and said first switch discharges energy from said inductor when said first switch is disconnected.

7. The bridgeless power factor corrector circuit of claim 6, wherein said control unit at a negative half cycle drives said first switch to maintain an electric connection, and said second switch is electrically connected first and then disconnected; and said second switch stores energy to said inductor when said second switch is electrically connected, and said second switch discharges energy from said inductor when said second switch is electrically disconnected.

* * * * *